United States Patent [19]

Simoneau

[11] Patent Number: 4,588,440

[45] Date of Patent: May 13, 1986

[54] CO CONTAINING AUSTENITIC STAINLESS STEEL WITH HIGH CAVITATION EROSION RESISTANCE

[75] Inventor: Raynald Simoneau, St-Bruno, Canada

[73] Assignee: Hydro Quebec, Montreal, Canada

[21] Appl. No.: 635,410

[22] Filed: Jul. 30, 1984

[30] Foreign Application Priority Data

Jun. 28, 1984 [CA] Canada ..... 457755

[51] Int. Cl.[4] ..... C22C 38/42; C22C 38/52; C22C 38/58

[52] U.S. Cl. ..... 75/126 B; 75/126 H; 75/126 C; 75/126 J; 75/128 A; 75/128 B; 75/128 N; 75/128 W

[58] Field of Search ..... 75/126 B, 126 H, 128 A, 75/128 B, 128 N, 128 W, 126 C, 126 J; 148/37, 38; 228/263.15; 428/685

[56] References Cited

U.S. PATENT DOCUMENTS

| | | | |
|---|---|---|---|
| 2,496,246 | 1/1950 | Jennings | 75/128 P |
| 2,536,034 | 1/1951 | Clarke, Jr. | 75/125 |
| 2,990,275 | 6/1961 | Binder et al. | 75/126 C |
| 3,154,412 | 10/1964 | Kasak et al. | 75/126 C |
| 3,251,683 | 5/1966 | Hammond | 75/128 B |
| 3,340,048 | 9/1967 | Floreen | 75/128 R |
| 3,719,476 | 3/1973 | Tanczyn | 75/125 |
| 3,772,005 | 11/1973 | deBarbadillo, II | 75/126 H |
| 3,873,378 | 3/1975 | Webster | 148/37 |
| 3,915,756 | 10/1975 | Oda et al. | 148/3 |

FOREIGN PATENT DOCUMENTS 2094342 9/1982 United Kingdom .

OTHER PUBLICATIONS

K. C. Antony et al, "The Effect of Composition and Microstructure on Cavitation and Erosion Resistance", 5th Int. Conf. on Erosion by Solid and Liquid impact, paper 67, Cambridge, England, Sep. 1979.

D. A. Woodford, "Cavitation-Erosion-Induced Phase Transformations in Alloys", *Metallurgical Transactions*, vol. 3, May 1972, pp. 1137-1145.

S. Vaidya et al, "The Role of Twinning in the Cavitation Erosion of Cobalt Single Crystals", *Metallurgical Transactions A*, vol. 11A, Jul. 1980, pp. 1139-1150.

D. A. Woodford et al, "A Deformation-Induced Phase Transformation Involving a Four-Layer Stacking Sequence in Co-Fe Alloy", *Metallurgical Transactions*, vol. 2, 1971, p. 3223.

D. Coutsouradis et al, "On the Microstructure of Co--Cr-Fe-C Alloys", *Cobalt*, vol. 13, Dec. 1961, pp. 4-23.

*Primary Examiner*—L. Dewayne Rutledge
*Assistant Examiner*—Robert L. McDowell
*Attorney, Agent, or Firm*—Schwartz, Jeffery, Schwaab, Mack, Blumenthal & Evans

[57] ABSTRACT

A soft, austenitic stainless steel alloy showing a high cavitation erosion resistance making it particularly useful for the manufacture and/or repair of hydraulic machine components. The alloy comprises from 8 to 30% by weight of Co; from 13 to 30% by weight of Cr; from 0.03 to 0.3% by weight of C; up to 0.3% by weight of N; up to 3% by weight of Si; up to 1% by weight of Ni; up to 2% by weight of Mo; and up to 9% by weight of Mn; the balance being substantially Fe. The amount of the above mentioned elements that are respectively known as ferrite formers (Cr, Mo, Si) and as austenite formers (C, N, Co, Ni, Mn) and, among said austenite and ferrite formers, the amount of each of the elements that are respectively known to increase and lower the stack fault energy, are respectively selected and balanced so that at least 60% by weight of the alloy is, at ambient temperature, in a metastable, face centered cubic phase having a stack fault energy low enough to make it capable of being transformed under cavitation exposure to a fine deformation twinning, hexagonal close pack $\epsilon$-phase and/or $\alpha$-martensitic phase.

16 Claims, 14 Drawing Figures

CO CONTAINING AUSTENITIC STAINLESS STEEL WITH HIGH CAVITATION EROSION RESISTANCE

BACKGROUND OF THE INVENTION (a) Field of the Invention

The present invention relates to a soft austenitic, Co-containing stainless steel alloy having a high resistance to high intensity cavitation making it particularly useful for the manufacture and/or repair of hydraulic machine components.

The invention also relates to hydraulic machine components made of, or covered with such an alloy.

(b) Brief Description of the Prior Art

The cavitation phenomenon to which hydraulic machines such as turbines, pumps, propellers, valves or exchangers are subjected, is a problem well known to specialists. By cavitation phenomenon is to be understood the phenomenon whereby a cavity or a vapor bubble develops in a liquid when the local pressure falls below the vapor pressure. When the pressure rises again above that of the vapor, the gas or vapor bubble abruptly collapses. This implosion is accompanied by powerful physical phenomena, namely by a microjet which follows the bubble and of which the speed may reach several hundred meters per second.

When such a microjet meets a wall, its kinetic energy is changed into a localized shock wave capable of deforming the hardest metallic surface and thus producing an important mechanical erosion. The intensity of the localized stresses produced by such impulses may spread over a very wide range depending on the natural conditions of the liquid, of the temperature and of the presence of foreign gases, of the rate in the pressure variation and of the liquid flow speed. These repeated shocks erode the metallic surface by propagating fatigue fissures (elastic deformation) or by plastic deformation leading to stripping of particles of small dimension.

The observations of damages on numerous groups of hydraulic machine components and the results of accelerated ultrasonic cavitation tests carried out by specialists including the instant inventor, have shown that the hydraulic machine components, especially the hydraulic turbines components, are generally subjected to a broad range of cavitation intensities which can be divided in two categories calling for two different solutions, one of these solutions being applicable to low intensity cavitation, the other one to high intensity cavitation.

Low intensity cavitation in hydraulic machines, especially hydraulic turbines has proved to occur on large areas and to attack mostly carbon steel, leaving stainless steel unaffected. This cavitation produces a slow erosion of carbon steel, which erosion is accelerated by corrosion and galvanic coupling with noble alloys such as stainless steel.

To overcome this part of the problem, the best solution consists in using components entirely made of stainless steel. Another solution consists in covering all the areas of carbon steel components subjected to low intensity cavitation, with a plurality of stainless steel welded overlays, in order to avoid the synergetic effect of cavitation-erosion galvanic corrosion.

On the other hand, high intensity cavitation has proved to occur in hydraulic machine components or groups operating at higher head and water velocities, on small localized areas only, such as, for examples, part of the back of turbine blades. This cavitation produces fast erosion even on high resistance materials such as austenitic stainless steels, at rates between 0.1 and 10 mm per year.

To overcome that part of the problem, high resistance materials are required. Hard alloys such as Co-based, STELLITE*-1 or -6 alloys, aluminum bronze, or highly resilient polymeric materials such as NYLON* 66 have been successfully tried and are used in some particular applications. However, it should be noted that these particular applications are rather limited in practice, because most of known, high resistance materials are difficult to grind and apply in addition of being expensive.

* trade-marks

It has recently been found that for some alloys, high hardness is not necessary for high cavitation resistance. K. C. Anthony et al. in their paper <<The Effect of Composition and Microstructure on Cavitation Erosion Resistance>>, 5th Int. Conf. on Erosion by Solid and Liquid Impact, paper 67, Cambridge, England, Sept. 1979, have shown that in Co-based Stellite-alloys, the cavitation-erosion resistance is not affected by lowering the carbon concentration from 1.3 down to 0.3 with the hardness going from 40 to 25 RC. This surprising result which is very important for cavitation erosion damage repair where grinding operation is difficult, has led to extensively test soft, Co-based alloys with a low carbon content, such as STELLITE-21, for the repair of cavitation damages in hydraulic turbines. These tests have proved that the soft, Co-based alloys are much more efficient than the austenitic stainless steel 308 or 301 as repair weld overlay material for localized high intensity cavitation erosion. More particularly, the tested alloys have proved to be easier to grind and, although of a higher cost, more economic to use because they last more than 10 times longer than stainless steels, thereby saving many repair outages.

The above mentioned fact that soft alloys, especially soft Co-based alloys, may have a high cavitation resistance, has not been satisfactory explained yet. Originally, the superior erosion behaviour of cobalt alloys such as STELLITE-6, was attributed to a strain induced martensitic transformation absorbing a significant fraction of the incident cavitation energy. However, subsequent experiments have shown that the contribution of such a martensitic transformation to erosion resistance, if any, is minor (see, for example, D. A. Woodford, <<Cavitation-Erosion-Induced Phase Transformation in Alloys>>, Met. Trans. Vol. 3, p. 1137, May 1972, and S. Vaidya et al, <<The Role of Twinning in the Cavitation Erosion of Cobalt Single Crystals>>, Met. Trans. A, Vol. llA, p. 1139, July 1980). The same experiments have rather shown that any improvement in erosion properties parallels a decrease in stacking fault energy (STE). It has therefore been suggested that the planar slip mode in low SFE materials delays the development of localized stresses required to initiate fracture, thus improving high-cycle fatigue strength.

S. Vaidya et al. have also suggested in their above mentioned article that fine-scale twinning is responsible for the superior erosion resistance of cobalt in hexagonal close pack form (hereinafter referred to as H.C.P. or $\epsilon$-phase), this particular form being a low temperature, stable form of cobalt coming from an allotropic transformation occuring at 420° C. in pure cobalt originally in face centered cubic form (such a form being hereinafter referred to as F.C.C. or γ-phase).

SUMMARY OF THE INVENTION

The present invention is based on the discovery that outstanding cavitation resistance similar to the one obtained with the alloys containing up to 65% Co may also be obtained with soft stainless steel alloys containing as low as 8% Co, provided that at least 60% of said low Co, stainless steel alloys be at ambiant temperature in a metastable, F.C.C. γ-phase having a stacking fault energy low enough to make it capable of being transformed under cavitation exposure to a H.C.P. ε-phase and/or to a α-martensitic phase showing a fine deformation twinning.

More particularly, the invention is based on the discovery that soft Fe-Cr-Co-C alloys showing a fine, cavitation-induced twinning, which twinning is specific to crystals having low stacking fault energy (SFE), surprisingly resist cavitation in a very efficient manner through the following mechanisms:

high strain hardening and strain accomodation, delaying fatigue crack initiation;

extension of planar twinning to the whole surface keeping it quite smooth and flat through an incubation period; and continuous absorption of the incident cavitation energy by the production of high dislocation density and very fine eroded particles, thus leading to very low erosion rates.

A first object of the present invention, which object is directly derived from the above mentioned discovery, is therefore to provide a soft, austenitic Co-containing stainless steel alloy having a high cavitation erosion resistance, which alloy comprises:

from 8 to 30% by weight of Co;
from 13 to 30% by weight of Cr;
from 0.03 to 0.3% by weight of C;
up to 0.3% by weight of N;
up to 3% by weight of Si;
up to 1% by weight of Ni;
up to 2% by weight of Mo; and
up to 9% by weight of Mn;
the balance being substantially Fe;

wherein the amounts of the above mentioned elements that are respectively known as ferrite formers (Cr, Mo, Si) and austenite formers (C, N, Co, Ni, Mn) and, amongst these ferrite and austenite formers, the amount of the above elements that are respectively known to increase the stacking fault energy (for example C and Ni) and to lower said stacking fault energy (for example Co, Si, Mn and N), are respectively selected and balanced so that at least 60% by weight of the alloy is, at ambient temperature, in a metastable face centered cubic (FCC) phase having a stacking fault energy (SFE) low enough to make it capable of being transformed under cavitation exposure to a hexagonal close pack (HCP) ε-phase and/or to a α-martensitic phase showing a fine deformation twinning.

As can be seen from the above formulation, the alloy according to the invention has a low carbon content (lower than 0.3%). This particular behaviour is consistent with the above mentioned observation made be K. C. Anthony et al, that high cavitation resistance of STELLITE-6 alloys is maintained with carbon content decreased from 1.3 down to 0.25%.

As indicated hereinabove, at least 60% by weight of the alloy according to the invention must be in an austenitic γ-phase, which is metastable and has a low stacking fault energy at ambient temperature.

Metastability of the γ-phase is a key feature of the invention, since it is compulsory that the alloy be capable of being transformed under cavitation exposure to a fine deformation twinning, hexagonal close pack ε-phase and/or α-martensitic phase. To achieve the necessary metastability of the γ-phase, the amount of ferrite formers (Cr, Mo, Si) and the amount of austenite formers (C, N, Co, Ni, Mn) contained in the alloy must be respectively selected and balanced in such a way as to barely stabilize austenite (i.e. the γ-phase) especially in case of rapid cooling, and promote cavitation-induced, phase transformation to ε-phase and martensite.

As also indicated hereinabove, the alloy according to the invention must also show a fine, cavitation-induced twinning specific to crystals having a low stacking fault energy. To achieve such a low stacking fault energy (SFE) the ability of each element to lower or increase the stacking fault energy of the crystals must be considered, and the respective amounts of the various elements selected to complete the composition of a given alloy according to the invention must, in light of the particular ability of each of said elements, be adjusted to lower the stacking fault energy of the whole composition to a level where fine deformation twinning can be induced by exposure to cavitation. Amongst the above mentioned elements that can be used in the alloys according to the invention, Ni and C are known to increase the S.F.E. while Co, Si, Mn and N are known to lower it. The last mentioned elements should therefore be preferably selected to lower as much as possible the S.F.E. of the composition. Amongst these last mentioned elements, cobalt is probably the most interesting element in that, in addition to lowering the S.F.E., it also permits to maintain the austenitic phase of the alloy in a metastable state over a large range of concentration.

The necessity for the alloys according to the invention to show a fine, cavitation-induced, deformation twinning is consistent with the observations made by S. Vaidya et al (see supra) who attributed the high cavitation resistance of high Co alloys to their low stacking fault energy and their fine planar deformation twinning. However, the fact that the alloy according to the invention with less than 30% Co and up to 70% Fe shows substantially the same low S.F.E. and fine deformation twinning as the high Co-alloy may appear to be rather surprising in light of the article published by D. A. Woodford et al, <<A Deformation-Induced Phase Transformation Involving a Four-Layer Stacking Sequence in Co-Fe Alloy>>. Met. Trans., 1971, vol. 2, p. 3223, where it was shown that, in Co-Fe alloys, only 15% Fe is sufficient to make the cavitation induced $\gamma \rightarrow \epsilon$ transformation completely vanish. A possible explanation to this particular behavious is that in the alloys according to the invention, chromium has a strong interaction with cobalt and iron to promote the formation of low SFE crystals.

The surface layer of the Fe-Cr-Co-C alloy according to the invention shows, after cavitation exposure, a very fine network of deformation twins in H.C.P. ε phase or α martensite. The presence of this continuous, fine twinning under cavitation exposure explains the high cavitation resistance of the alloy. This fine twinning indeed is an efficient means of absorbing the incident cavitation impact energy. This fine twinning is also an efficient means of strain accomodation avoiding high stress concentration and delaying fatigue crack initiation and propagation. The local strain hardening associated with the fine twinning promotes the extension of the twinning to the whole exposed surface at the beginning of cavitation exposure (incubation period). This explains why this surface remains so flat and smooth during the incubation period in contrast with the high surface relief produced in wavy deforming materials. The smoother surfaces indeed are less attacked by the local tangential flow produced by the cavitation implosion. Thus, during the incubation period, the only relief on the Co alloys according to the invention are the fine twinning surface steps. Finally, this very fine twinning leads to very low erosion rate through the removal of very fine particles at the twin intersections. The large quantity of created new surfaces for a given metal loss volume thus produced is another efficient way of absorbing the incipient cavitation energy.

In accordance with a preferred embodiment of the invention, the austenitic, Co-containing stainless steel alloy according to the invention advantageously comprises:

from 10 to 30% by weight of Co;
from 13 to 28% by weight of Cr;
from 0.25 to 0.3% by weight of C;
and up to 2% by weight of Mo;
the balance being substantially Fe;

wherein the respective amount of each of the above elements is selected and balanced as explained hereinabove.

In this preferred embodiment, a particularly suitable alloy is the one comprising 10% by weight of Co; 18% by weight of Cr and 0.3% of C, the balance being substantially Fe. Indeed, this particular alloy which is very efficient, is one of the cheapest. In this connection, it may be noted that the composition of this particular alloy is substantially equivalent to the composition of the standard 300 series stainless steel, the only difference being the absence of Ni (known to increase the SFE) replaced by an increased amount of Co (known to lower the SFE).

In accordance with another preferred embodiment of the invention, the austenitic, Co-containing stainless steel alloy according to the invention advantageously comprises:

from 8 to 30% by weight of Co;
from 13 to 30% by weight of Cr;
from 0.03 to 0.3% by weight of C;
from 3 to 9% by weight of Mn;
up to 0.3% by weight of N;
up to 3% by weight of Si;
up to 1% by weight of Ni; and
up to 2% by weight of Mo;
the balance being substantially Fe.

Of course, the respective amount of each of the above elements is selected and balanced as explained hereinabove.

As aforesaid, the stainless steel alloys according to the invention are soft. They are cheaper than the conventional high Co alloys such as STELLITE-6 or STELLITE-21, and have substantially the same outstanding cavitation resistance as these high Co alloys. As a result, the alloys according to the invention form an economical alternative to the STELLITE-21 type alloys used today for protecting hydraulic machines againsts cavitation erosion. Welding wires or electrodes made of such alloys can be hot and cold rolled and used for cavitation damage field repair. Hydraulic machine components may also be cast directly from such alloys to allow development and fabrication of high cavitation resistance hydraulic machines.

A second object of the present invention is to provide a stainless steel component for use in the manufacture or repair of a hydraulic machine, which component is made of, or covered with, a stainless steel alloy according to the invention.

The stainless steel components according to the invention have a cavitation resistance at least equal to the components made of the harder STELLITE-1 or -6 alloys. Since the alloy according to the invention is soft, they are much more easily grindable. Actually, they have all the advantages of the components made of the softer, high Co alloys of the STELLITE-21 type, but at lower cost.

BRIEF DESCRIPTION OF THE DRAWINGS

Other advantages and features of the present invention will become apparent from the description that follows of tests and experiments carried out by the inventor, having reference to the appended drawings wherein:

FIG. 1 shows a comparison of cavitation weight losses versus time for various steels and Co-alloys;

FIG. 4 shows a comparison of cavitation erosion rate, induced phase transformation and hardening of various Co-alloys; and FIG. 5 shows a comparison of surface microhardness versus cavitation time and of cross-section microhardness versus depth of eroded specimens of steels and Co-alloys.

DESCRIPTION OF TESTS AND EXPERIMENTS CARRIED OUT BY THE INVENTOR

Experimental Procedure

Figure 7:
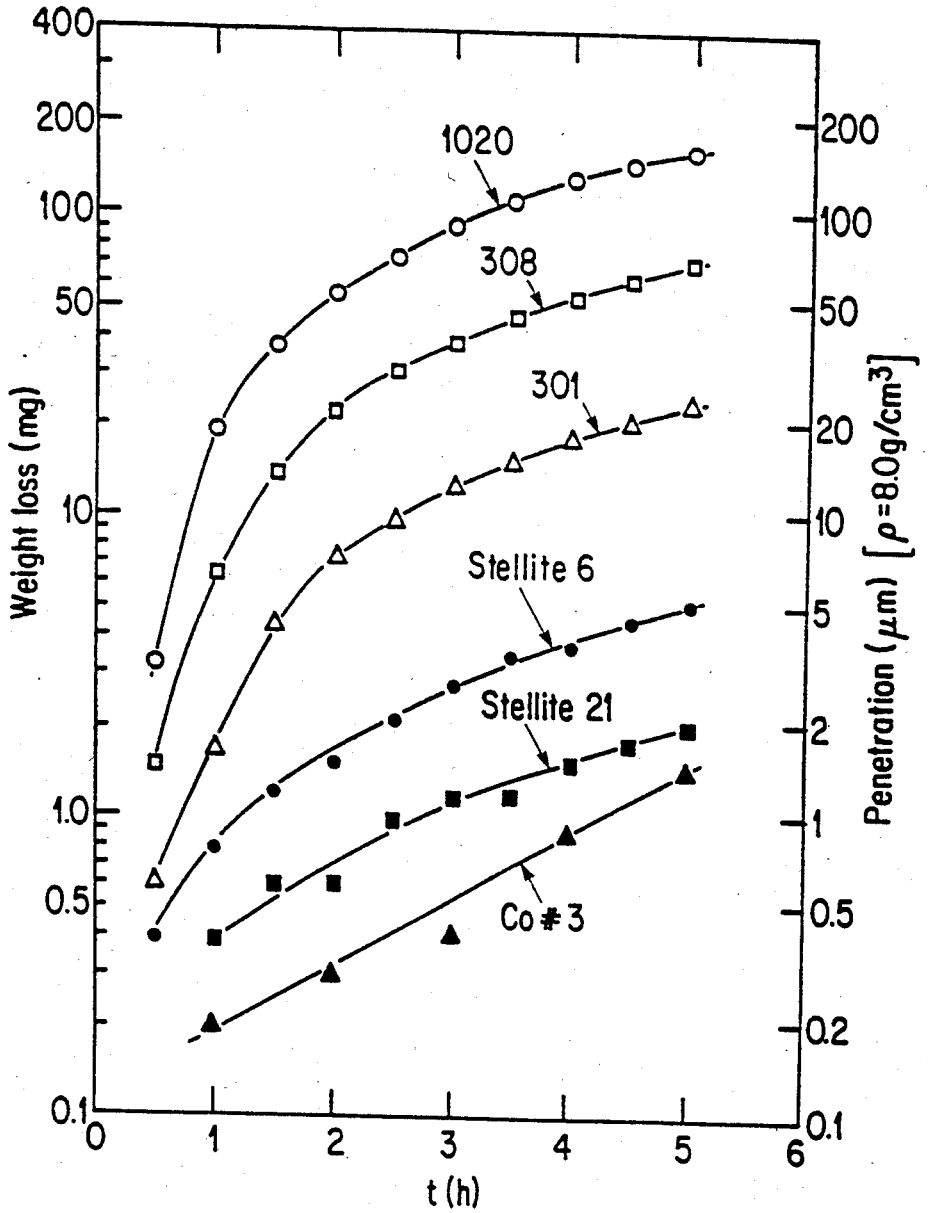

The experimental results and data reported hereinafter were obtained as follows.

(a) High Intensity Cavitation Erosion Resistance

High intensity cavitation erosion resistance was measured according to the standard ASTM-G32 ultrasonic cavitation test. Weight losses of 16 mm cylindrical specimens vibrating at 20 k Hz with a double amplitude of 50 μm in distilled water at 22° C. were measured every half hour over a period of 6 hours with an electrical balance accurate to 0.1 mg. The materials tested are listed in the following table I with their nominal composition, their fabrication process, their hardness and their original crystallographic structure.

TABLE 1

Composition and performance of tested alloys

| IDENTIFICATION | COMPOSITION (% by weight) Co | Cr | Fe | C | Other | | | PHASES % | Hardness (Rockwell) | Cavitation erosion rate (mm/year) |
|---|---|---|---|---|---|---|---|---|---|---|
| 1020 steel[1] | — | — | 99 | .2 | Ni | Mo | — | 75α-25 pearlite | 89 RB | 280 |
| 308 steel[2] | — | 18 | 72 | .04 | 9 | — | — | 99γ-1α | 89 RB | 115 |
| 301 steel[2] | — | 17 | 75 | .1 | 7 | — | — | 77γ-23α | 94 RB | 41 |
| STELLITE 21[2] | 60 | 25 | 11 | .25 | — | 4 | — | 99γ-1ε | 30 RC | 3.2 |
| STELLITE 21[3] | 39 | 23 | 35 | .2 | — | 3 | — | 99γ-1ε | 24 RC | 9.3 |
| Co #1[4] | 30 | 25 | 40 | .25 | — | 2 | — | 100γ | 94 RB | 1.8 |
| Co #2[4] | 30 | 13 | 55 | .25 | — | 2 | — | 100γ | 25 RC | 7.2 |
| Co #3[4] | 20 | 28 | 51 | .3 | — | 1 | — | 97γ-3ε | 23 RC | 2.2 |
| Co #4[4] | 20 | 18 | 61 | .3 | — | 1 | — | 88γ-12ε | 22 RC | 4.5 |
| Co #5[4] | 10 | 28 | 62 | .3 | — | .5 | — | 16γ-84α | 21 RC | 98 |
| Co #6[4] | 10 | 18 | 72 | .3 | — | — | — | 93γ-6α | 28 RC | 3.6 |
| Co #7[4] | 20 | 23 | 50 | .15 | 6 | — | — | 100γ | 85 RB | 10.2 |
| Co #8[4] | 15 | 28 | 56 | .3 | | | | 99γ | 27 RC | 4.0 |
| Co #9[4] | 15 | 18 | 66 | .3 | | | | 95γ | 24 RC | 3.7 |
| Co #10[4] | 20 | 13 | 66 | .3 | | | | 60γ-40α | 32 RC | 6.7 |
| Co #11[4] | 8 | 18 | 74 | .3 | | | | 2γ-98α | 37 RC | 63 |
| Co #12[4] | 5 | 18 | 77 | .3 | | | | 100α | 30 RC | 99 |
| Co #13[4] | 15 | 13 | 72 | .3 | | | | 100α | 42 RC | 42 |
| Co #14[4] | 10 | 13 | 77 | .3 | | | | 100α | 44 RC | 37 |
| Co #15[4] | 5 | 13 | 82 | .3 | | | | 100α | 43 RC | 38 |
| Co #16[4] | 12 | 19 | 70 | .2 | Si | Mn | N | 50γ-50α | 38 RC | 15 |
| Co #17[4] | 12 | 19 | 69 | .2 | 1 | — | — | 85γ-15α | 28 RC | 12 |
| Co #18[4] | 12 | 19 | 68 | .2 | 1 | 1 | — | 92γ-8α | 24 RC | 14 |
| Co #19[4] | 12 | 19 | 68 | .2 | 1 | 1 | .2 | 99γ-1α | 20 RC | 6.6 |
| Co #20[4] | 12 | 19 | 68 | .1 | 1 | 1 | .2 | 98γ-2α | 20 RC | (porous) |
| Co #21[4] | 12 | 19 | 66 | .2 | — | 3 | .05 | 99γ-1α | 21 RC | 4.8 |
| Co #22[4] | 12 | 19 | 60 | .2 | — | 9 | .05 | 100γ | 95 RB | 8.1 |
| Co #23[4] | 8 | 13 | 57 | .1 | 3 | 9 | .05 | 100γ | 26 RC | 2.4 |
| Co #24[4] | 12 | 13 | 66 | .2 | — | 9 | .05 | 100γ | 21 RC | 4.2 |
| Co #25[4] | 12 | 19 | 66 | .2 | 3 | — | .1 | 100γ | 21 RC | 14.2 |

[1]hot rolled
[2]2 layers weld overlay
[3]1 layer weld overlay
[4]experimental alloys: as melted in a small copper cooled laboratory arc furnace.

The experimental cobalt alloys Co #1 to Co #25 listed in the above table were prepared by remelting on a water cooled copper plate of a small laboratory arc furnace appropriate mixtures of some of the following constituents: carbon steel, 304 stainless steel, STELLITE 21, ferrochromium, electrolytic cobalt, ferromanganese and ferrosilicium. It should be noted that the composition of each of these experimental alloys except Co. #7, 12 and 15 that were tested by way of reference, falls within the above mentioned range of composition of the Co-containing stainless steel alloys according to the invention.

(b) Other Measurements

Metallographic observation, microhardness measurement and X-ray diffraction were made after various duration of cavitation exposure.

The metallographic observation was made on optical and scanning electron micrographies taken of the eroded surfaces of the experimental materials after various time of cavitation exposure. The surfaces were originally electrochemically polished and etched.

The microhardness measurement was made by application of a pyramidal diamond on the eroded surface of the experimental materials after various time of cavitation exposure, until this surface was too bossy to allow measurement.

To perform X-ray diffraction, the longer $CuK_\alpha$ wavelength was chosen so that only a thin surface layer (~10 μm) is diffracting. Cavitation exposure time was chosen within the final part of the incubation period so that surface erosion had just started.

Cavitation Erosion Tests

Figure 2:
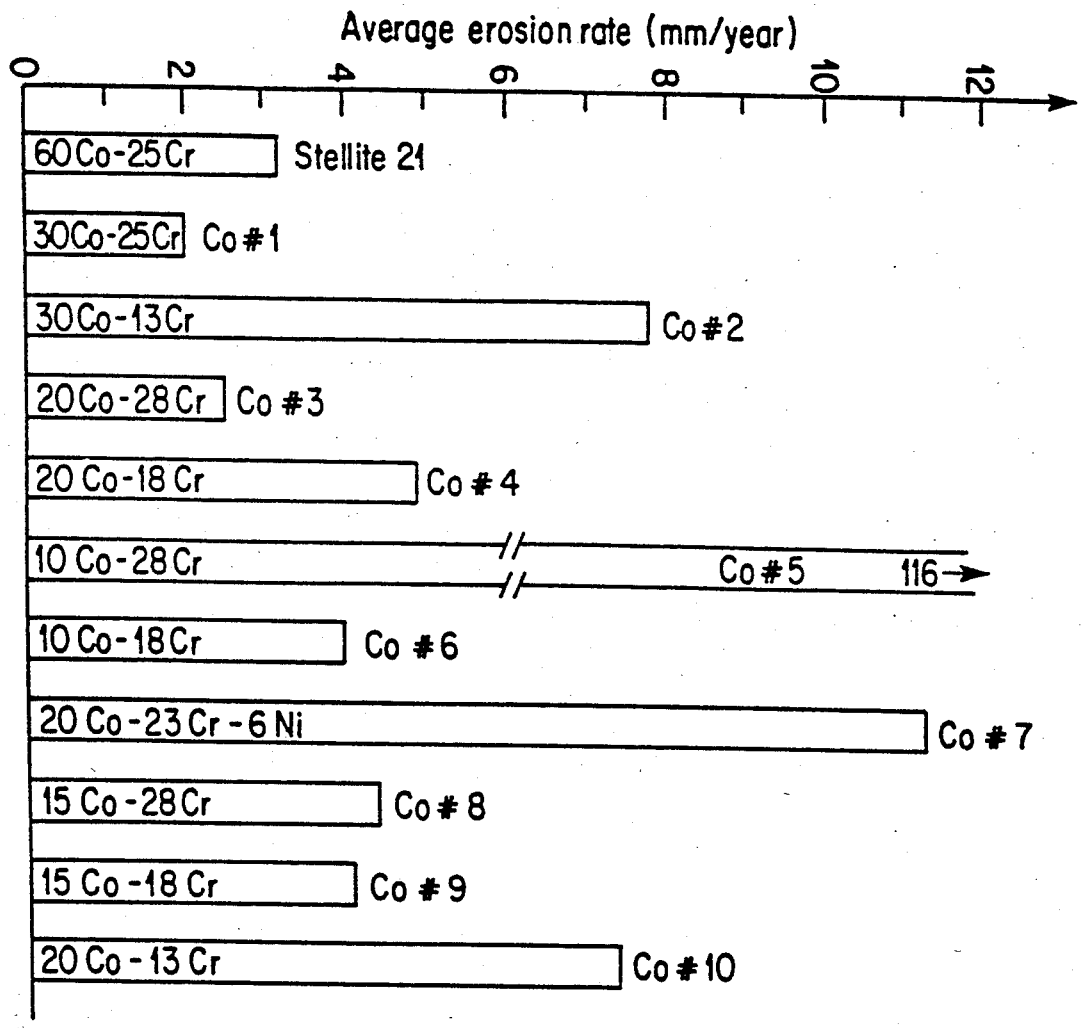
FIG. 2 shows average erosion rates of Co-alloys according to the invention measured in ultrasonic cavitation tests.
Figure 3A:
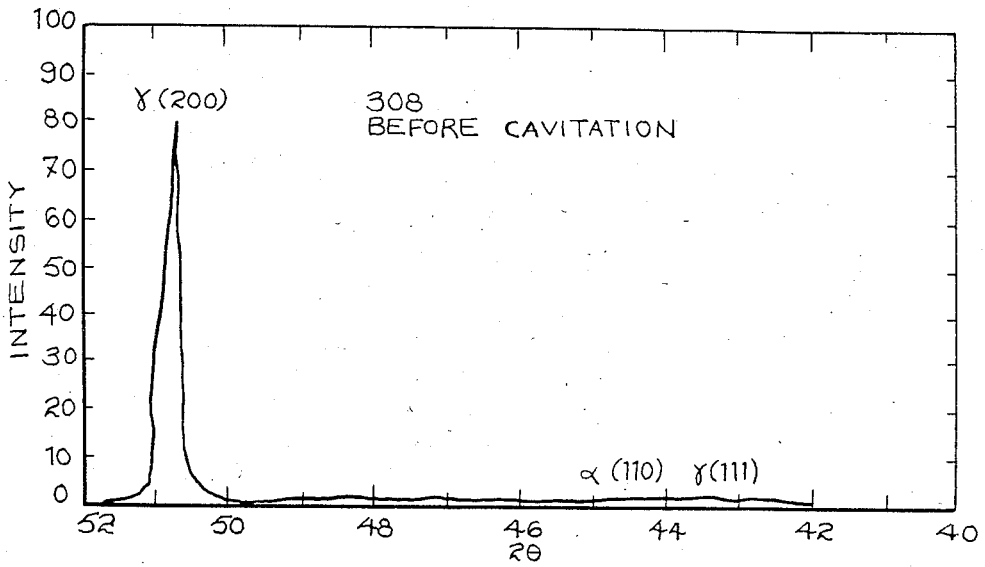
FIGS. 3*a* - 3*l* illustrate X-rays diffraction spectra showing cavitation-erosion induced phase transformation of various Co-alloys.
Figure 3B:
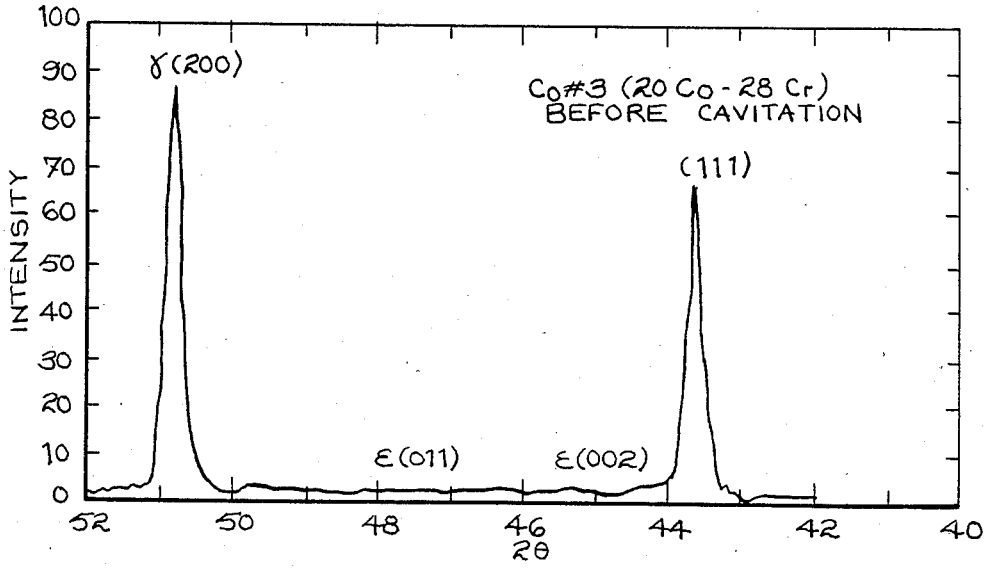
Figure 3C:
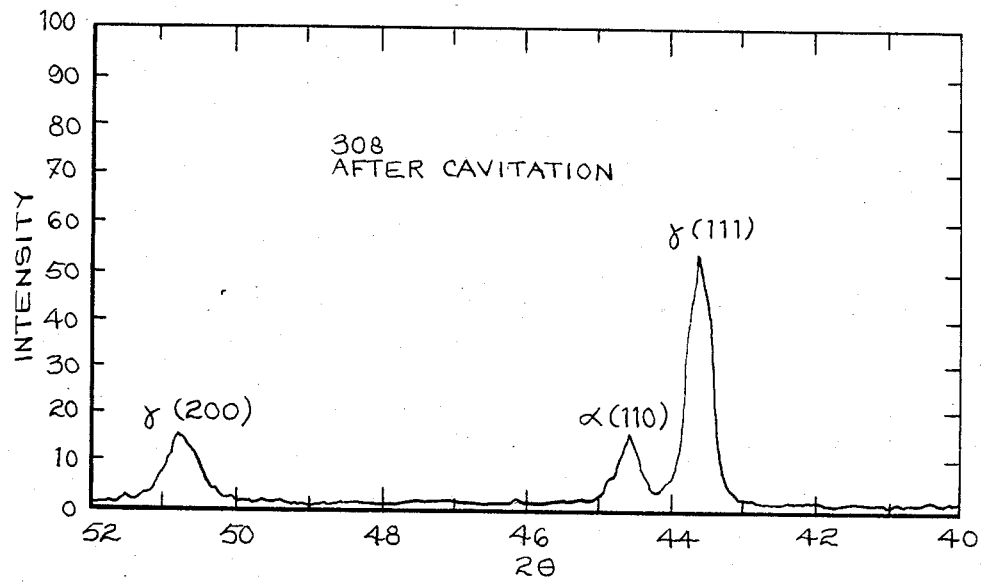
Figure 3D:
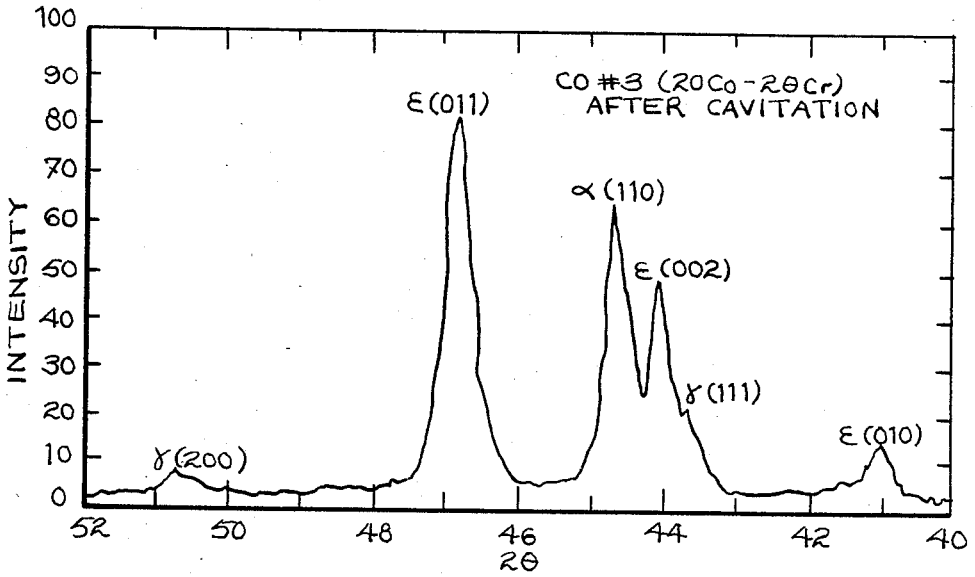
Figure 3E:
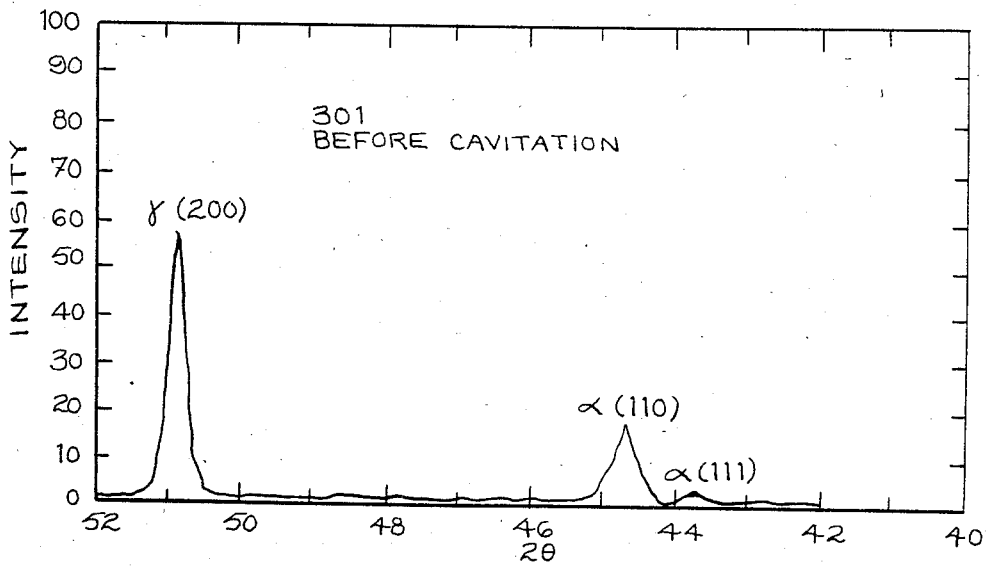
Figure 3F:
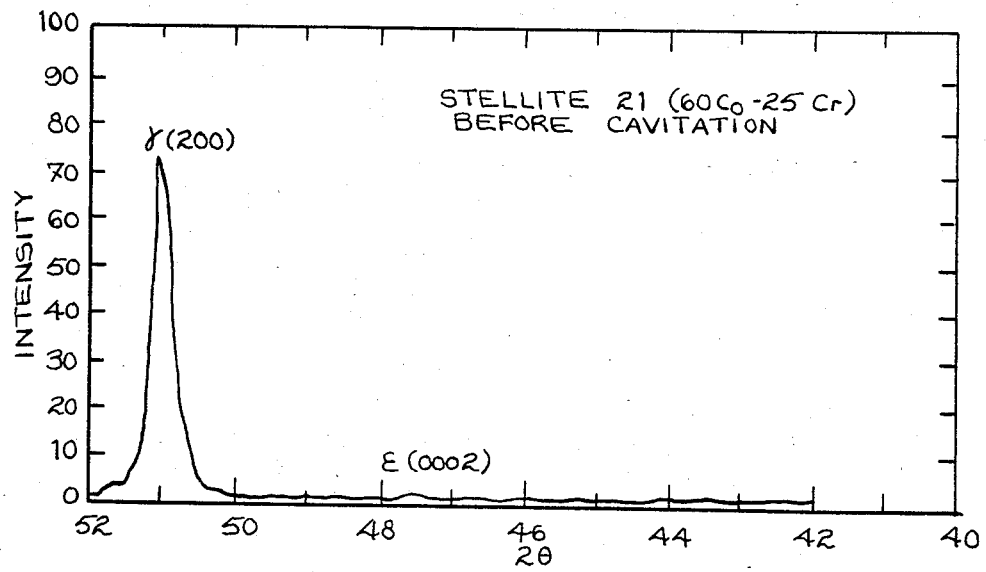
Figure 3G:
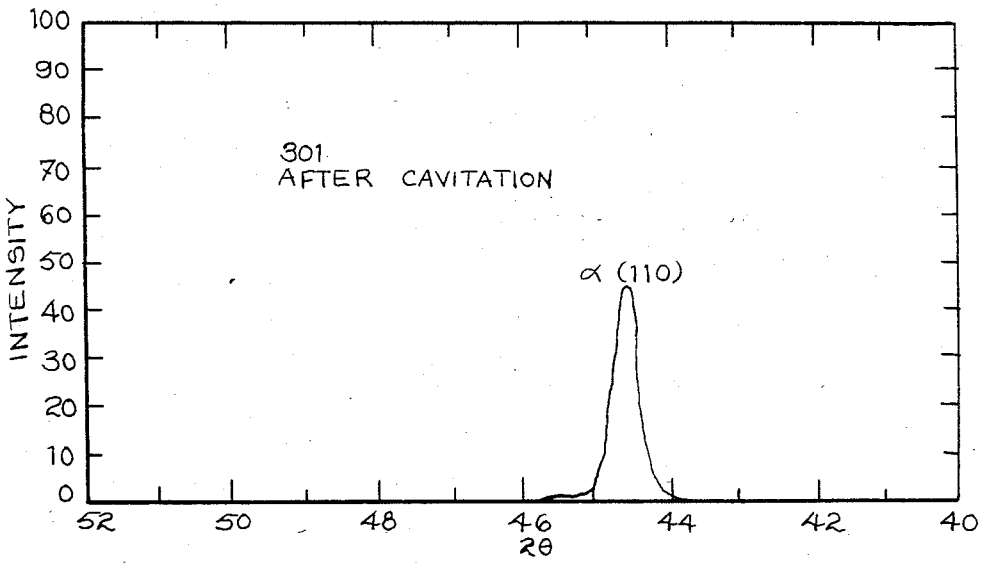
Figure 3H:
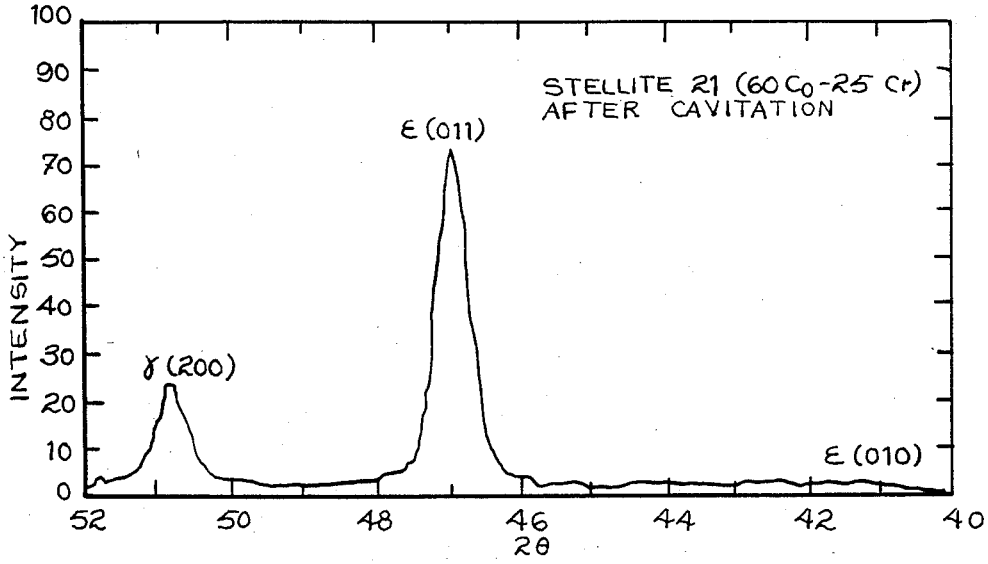
Figure 3I:
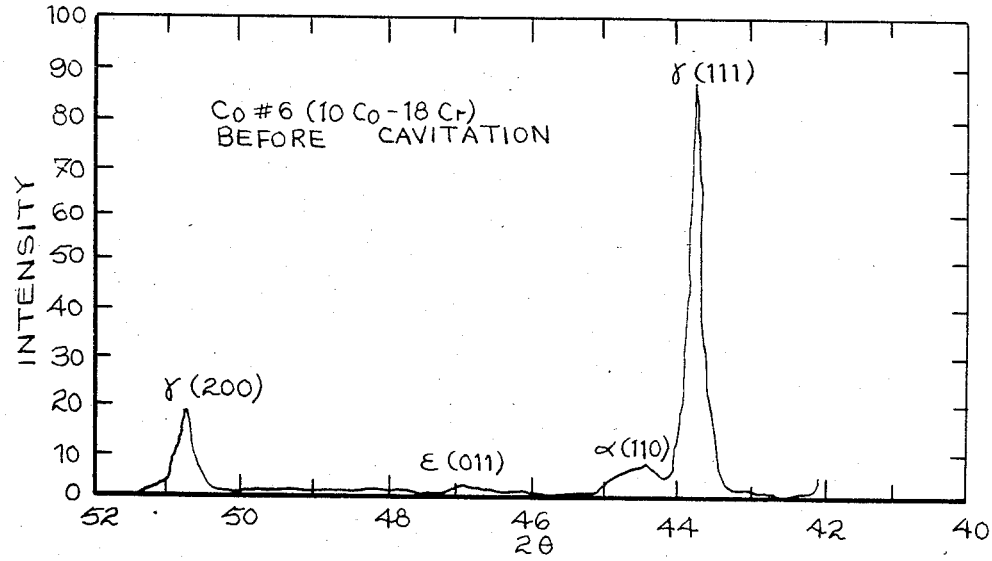
Figure 3J:
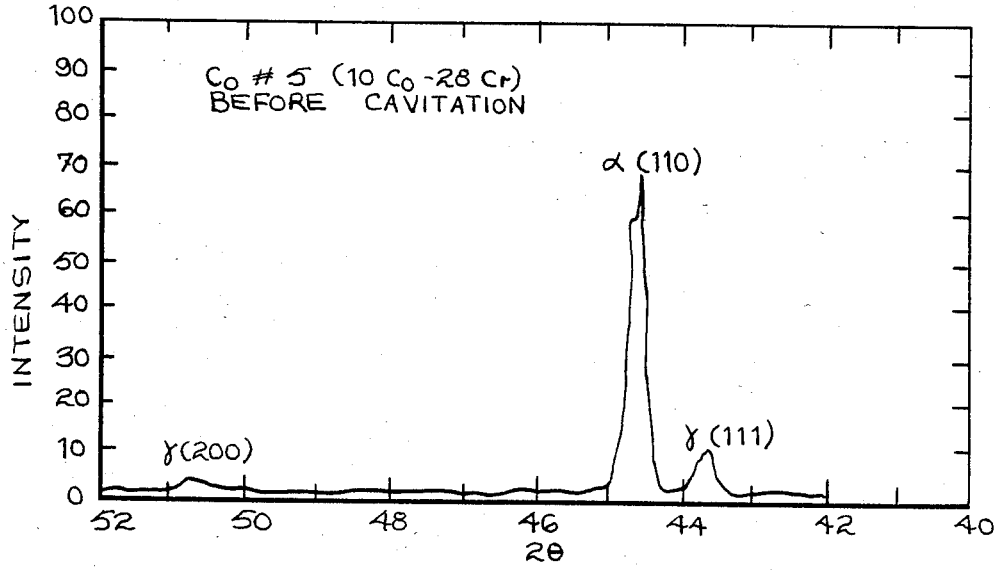
Figure 3K:
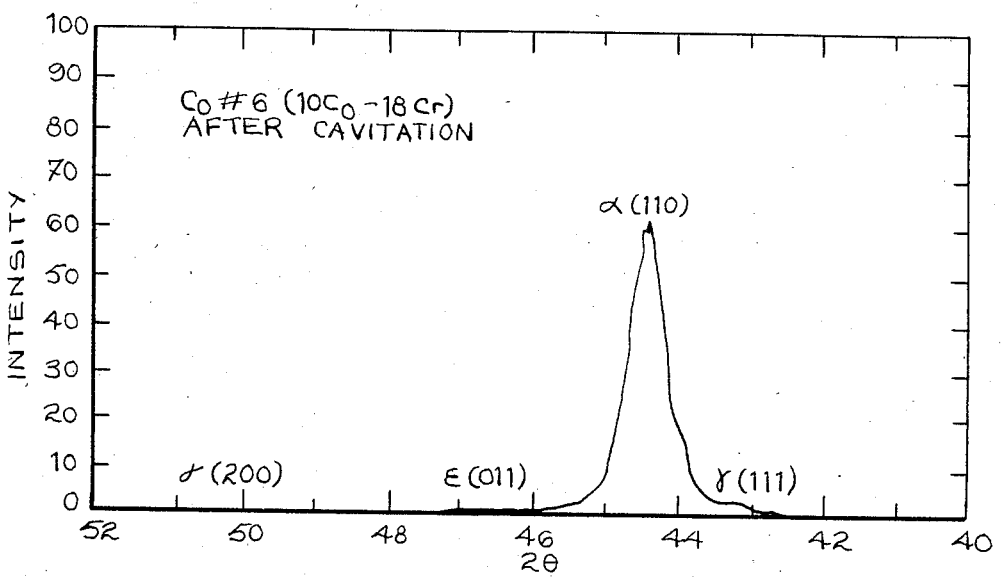
Figure 3L:
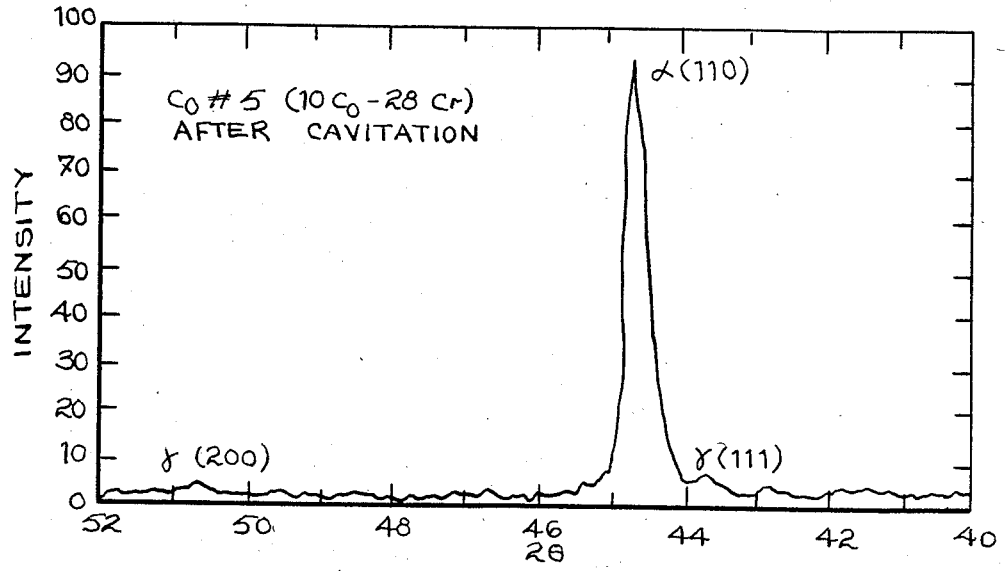

Table 1 and FIGS. 1 and 2 summarize the results of cavitation erosion tests carried out by the inventor. These results clearly show that 308 stainless steel has twice the cavitation resistance of 1020 carbon steel and that all the experimental Co-Cr-Fe alloys, except Co #5, 7 and 11 to 15 have a much better cavitation resistance, from 10 to 50 time higher, than 308 stainless steel eventhough they have only marginally higher hardness.

X-ray Diffraction

The results of the X-ray diffraction tests carried out by the inventor are reported and summarized in FIGS. 3 and 4 and in following table 2.

TABLE 2

Cavitation-erosion induced phase transformation

| | Cavitation exposure time | α (ferrite or martensite) (BCC) $I(110)/I_T$ (%), d(110) | γ (austenite) (FCC) $I(220) + I(III)I_T$ (%), d(200) | ε (HCP) $I(011) + I(002/I_T$ (%), d(011) |
|---|---|---|---|---|
| 1020 | 0 | 100, 2.026 | 0, — | 0, — |

TABLE 2-continued

| | Cavitation-erosion induced phase transformation | | | |
|---|---|---|---|---|
| | Cavitation exposure time | α (ferrite or martensite) (BCC) I(110)/ $I_T$ (%), d(110) | γ (austenite) (FCC) I(220) + I(III)$I_T$ (%), d(200) | ε (HCP) I(011) + I(002/$I_T$ (%), d(011) |
| | 1h | 100, 2.029 | 0, — | 0, — |
| 308 | 0 | 1, 2.026 | 99, 1.796 | 0, — |
| | 2h | 17, 2.030 | 83, 1.796 | 0, — |
| 301 | 0 | 23, 2.026 | 77, 1.794 | 0, — |
| | 2h | 100, 2.023 | 0, — | 0, — |
| Co #3 | 0 | 0, | 97, 1.796 | 3, 1.941 |
| 20 Co—28 Cr, | 4h | 30, 2.030 | 7, 1.799 | 63, 1.939 |
| Co #4 | 0 | 0, | 88, 1.800 | 12, 1.937 |
| 20 Co—18 Cr, | 4h | 83, 2.036 | 14, 1.807 | 3, 1.941 |
| Co #5 | 0 | 84, 2.033 | 16, 1.797 | 0, — |
| 10 Co—28 Cr, | 2h | 95, 2.020 | 5, 1.797 | <1, — |
| Co #6 | 0 | 6, 2.034 | 93, 1.799 | 1, — |
| 10 Co—18 Cr, | 4h | 97, 2.039 | 2, — | 1, — |
| Stellite 21, | 0 | 0, | 99, 1.796 | 1, 1.941 |
| 60 Co—28 Cr, | 4h | 0, | 24, 1.799 | 76, 1.939 |

The above table shows that the 1020 carbon steel specimen was the only material that showed no deformation induced transformation after cavitation exposure. As expected, only a small proportion of the eroded surface of the 308 austenitic stainless steel specimen was transformed to martensite. It is worth noting that on this alloy, cavitation exposure changed the surface texture, eroding away the (200) surface oriented grains and revealing the higher resistance (111) grains.

The 301 stainless steel was partially martensitic as welded and its surface was completely transformed to martensite under cavitation. The alloy Co #5 (10% Co) was mainly ferritic as melted and its small fraction of austenite did transform almost completely to martensite under cavitation exposure. The alloy Co #3 (20% Co), austenitic as melted, was superficially changed mainly to HCP ε phase and to some martensite, whereas the STELLITE 21 surface transformed less extensively to HCP ε only. Surprisingly, the alloy Co #6 (10% Co-18% Cr) showed the same outstanding cavitation resistance with induced transformation to α martensite and not to ε phase. On the opposite, the alloys Co #11 to 15 that were martensitic as cast (see Table 1), did not show the best cavitation performance.

From the above results, one can see that the degree of cavitation-induced transformation goes in the following increasing order: 1020 (~0%), Co #5 (~10%), 308 (~15%), 301 (~75%), STELLITE 21 (~75%), Co #3 (~90%), Co #6 (~90%).

As shown on FIG. 4, the cavitation induced hardening follows the same trend.

Microhardness

The results of the microhardness measurement conducted by the inventor are presented on FIG. 5.

FIG. 5*a* show that there is a larger increase in surface hardness during the incubation period for the higher resistance alloys. No deformation hardening has been measured on the soft ferrite of the carbon steel specimen. The experimental Co #3 alloy, which is, as melted, softer than STELLITE 21, showed the highest hardening, with final hardness higher than that of STELLITE 21. This hardening increased very rapidly in the early stage of the incubation period.

The microhardness measurement on cross-sections, reported in FIG. 5*b*, show that the cavitation-deformation hardening is restricted to a very thin surface layer (<50 μm), which makes these types of measurements very difficult.

Micrographies

Various micrographies were taken of the surface of some of the experimental materials after cavitation exposure.

On the surface of the 1020 carbon steel specimen, impact traces of cavitation implosion producing a bossy rougher surface were revealed by Nomarski's illumination. The boss and pit density increased rapidly with cavitation time reaching more than 2000/mm$^2$ after only 30 sec. The ferrite was very much more deformed than the pearlite, being cracked, torn apart and separated from the tougher pearlite colonies after only 30 min.

About the same roughening mechanisms were observed on the 308 austenitic stainless steel specimen, except that cracking and tearing occured later and more homogeneously on this single phase material. Very few and very faint martensitic lines could be seen on the deformed surface. On the 301 specimen, the coarse martensite lathes already present in the as welded deposit, were refined and multiplied by the cavitation impacts. Roughening was less pronounced and many small tearing were seen after 30 min.

On two of the Co alloys, namely STELLITE 21 (65% Co) and Co #3 (20% Co), a quite different behaviour was observed. The impact pits were very small and did not lead to a deep surface roughening. Numerous slip lines, that have been already identified in the litterature as twinning lines in pure Co, appeared very soon, after only a few seconds of cavitation exposure. As cavitation time went on, twinning line density and twinning deformation increased, leading to a very dense network of very fine intersecting twins after 1 or 2 hours. Then erosion started by tearing apart of small square particles produced by interface cracking at the twin or grain boundaries. In the experimental Co #3 alloy, the twinning area were separated by small interdendritic martensitic regions which seemed to be very fine and possessed as good cavitation resistance as the finest parallel twinning areas. As in pure cobalt, grain orientation which favors the finest parallel twinning in the dense plane (0001) HCP showed the highest cavitation resistance. The same fine twinning was also observed in the pure martensite of transformed alloy Co #6.

Observations of micrographies taken on cross sections also revealed a larger deformation and cracking zone (~30 μm) for 1020 carbon steel. This zone was much smaller for the stainless steels (a few microns). In the Co-alloy specimen, the cavitation strained surface layer seemed to be very thin (<1 μm). No cavitation induced twinning could be revealed on these cross-sections. It is interesting to note how the observed under-surface areas seemed unaffected by the cavitation impact as if surface twinning was an extremely efficient means of absorbing or shielding the cavitation impact. As a general trend, the higher was the cavitation resistance of a material, the smoother its surface remained under cavitation exposure.

Experimental Conclusion

The above reported tests, measurements and observations clearly show that all the experimental alloys according to the invention, except Co #5, 7 and 11 to 15 have substantially the same outstanding cavitation resistance as the high Co alloys such as STELLITE 21.

The above reported data, especially from X-ray diffraction, also show that the superior cavitation resistance of the Co-alloys according to the invention can be attributed to a fine network of deformation twins associated with the transformation to HCP ε phase or α martensite, such a fine, cavitation induced twinning being specific to crystals having a low stack fault energy.

The fact that no fine twinning and poor cavitation resistance were observed on the experimental alloy Co #5 and 11 to 15 that was mainly ferritic or martensitic before being subjected to cavitation exposure, seems to indicate that a cavitation-induced, phase transformation from a F.C.C. γ phase to a fine deformation twinning H.C.P. ε phase and/or α martensitic phase is compulsory to obtain a high cavitation resistance. This requirement in turn involves that the alloys according to the invention be in a metastable austenitic phase at ambient temperature.

If the stability of the austenitic phase of the alloy is too good, the phase transformation under cavitation exposure will be small. Thus, by way of example, the alloy Co #3 (20% Co) according to the invention which has a cavitation induced phase transformation and a strain hardening more pronounced that STELLITE 21 (65% Co) which is known as being very stable, also has a superior cavitation resistance, eventhough it has a lower initial hardness (23 RC as compared to 30 RC for STELLITE 21). In this connection, it may be noted that the optimum composition for cavitation resistance thus may include some solution hardening addition such as molybdenum, to maintain the same degree of phase transformation.

It is therefore apparent that, just like in the 301 stainless steel, the amount of ferrite formers (Cr, Mo and Si) and of austenite formers (C, N, Co and Ni) contained in the alloys according to the invention must be balanced in such a way as to barely stabilize austenite especially in case of rapid cooling, and simultaneously promote cavitation-induced, phase transformation from γ-phase to ε-phase or α-martensite, the higher cavitation resistance of the alloys according to the invention essentially resulting from its composition where the amount of the elements increasing the SFE, mainly C and Ni, is reduced as much as possible and replaced by elements lowering the SFE (Co, Si, Mn and N) to provide finer deformation twinning.

The soft Co alloys according to the invention can advantageously be used for the manufacture or repair of hydraulic machine components such as turbine, pump, tap and the like. It can be used as protective layer welded onto a core of carbon steel, or cast as such. It can be hot- or cold-formed into sheets, welding wires or electrodes for use in cavitation damage field repair, in replacement of the more expensive STELLITE 21 used for such repair up to now.

It must be noted that no special thermal or mechanical treatment is required in the as-cast or as-welded state for the best cavitation resistance of the Co austenitic stainless steels according to the invention. They can be used as cast, which makes them applicable for welding filler metal. If they must be cold deformed for shaping purposes into flat or wire product for example, then they will require a high temperature annealing treatment as the plain austenitic stainless steels. Their better formability than the Co-based alloys is another economical advantage for the fabrication of welding wires.

I claim:

1. A stainless steel alloy showing a high cavitation erosion resistance, said alloy consisting essentially of:
from 8 to 30% by weight of Co;
from 13 to 30% by weight of Cr;
from 0.03 to 0.3% by weight of C;
up to 0.3% by weight of N;
up to 3% by weight of Si;
up to 1% by weight of Ni;
up to 2% by weight of Mo; and
up to 9% by weight of Mn;
the balance being substantially Fe,
wherein the amount of the above mentioned elements that are respectively known as ferrite formers (Cr, Mo, Si) and as austenite formers (C, N, Co, Ni, Mn) and, amongst said austenite and ferrite formers, the amount of each of the elements that are respectively known to increase and lower the stacking fault energy (Ni, C, Co Si, Mn, N), are respectively selected and balanced so that at least 60% by weight of the alloy is, at ambient temperature, in a metastable, face centered cubic phase having a stacking fault energy low enough to make it capable of being transformed under cavitation exposure to a fine deformation twinning, hexagonal close pack ε-phase and/or α-martensitic phase.

2. A stainless steel alloy as claimed in claim 1, said alloy consisting essentially of:
from 10 to 30% by weight of Co;
from 13 to 28% by weight of Cr;
from 0.25 to 0.3% by weight of C; and
up to 2% by weight of Mo;
the balance being substantially Fe,
wherein the amount of the above mentioned elements that are respectively known as ferrite formers and as austenite formers and, amongst said austenite and ferrite formers, the amount of each of the elements that are respectively known to increase and lower the stacking fault energy, are respectively selected and balanced so that at least 60% by weight of the alloy is, at ambient temperature, in a metastable, face centered cubic phase having a stacking fault energy low enough to make it capable of being transformed under cavitation exposure to a fine deformation twinning, hexagonal close pack ε-phase and/or α-martensitic phase.

3. A stainless steel alloy as claimed in claim 2, said alloy consisting essentially of:

about 10% by weight of Co;
about 18% by weight of Cr; and
about 0.3% by weight of C;
the balance being substantially Fe.

4. A stainless steel alloy as claimed in claim 2, said alloy consisting essentially of:
about 15% by weight of Co;
about 28% by weight of Cr; and
about 0.3% by weight of C;
the balance being substantially Fe.

5. A stainless steel alloy as claimed in claim 2, said alloy consisting essentially of:
about 15% by weight of Co;
about 18% by weight of Cr; and
about 0.3% by weight of C;
the balance being substantially Fe.

6. A steel alloy as claimed in claim 2, said alloy consisting essentially of:
about 20% by weight of Co;
about 13% by weight of Cr; and
about 0.3% by weight of C;
the balance being substantially Fe.

7. A stainless steel alloy as claimed in claim 2, said alloy consisting essentially of:
about 20% by weight of Co;
about 28% by weight of Cr;
about 0.3% by weight of C; and
about 1% by weight of Mo;
the balance being substantially Fe.

8. A steel alloy as claimed in claim 2, said alloy consisting essentially of:
about 20% by weight of Co;
about 18% by weight of Cr;
about 0.3% by weight of C; and
about 1% by weight of Mo;
the balance being substantially Fe.

9. A stainless steel alloy as claimed in claim 2, said alloy consisting essentially of:
about 30% by weight of Co;
about 25% by weight of Cr;
about 0.25% by weight of C; and
about 2% by weight of Mo;
the balance being substantially Fe.

10. A stainless steel alloy as claimed in claim 2, said alloy consisting essentially of:
about 30% by weight of Co;
about 13% by weight of Cr;
about 0.25% by weight of C; and
about 2% by weight of Mo;
the balance being substantially Fe.

11. A stainless steel alloy showing a high cavitation erosion resistance, said alloy consisting essentially of:
from 8 to 30% by weight of Co;
from 13 to 30% by weight of Cr;
from 0.03 to 0.3% by weight of C;
from 3 to 9% by weight of Mn;
up to 0.3% by weight of N;
up to 3% by weight of Si;
up to 1% by weight of Ni; and
up to 2% by weight of Mo;
the balance being substantially Fe,
wherein the amount of the above mentioned elements that are respectively known as ferrite formers (Cr, Mo, Si) and as austenite formers (C, N, Co, Ni, Mn) and, amongst said austenite and ferrite formers, the amount of each of the elements that are respectively known to increase and lower the stacking fault energy (Ni, C, Co, Si, Mn, N), are respectively selected and balanced so that at least 60% by weight of the alloy is, at ambient temperature, in a metastable, face centered cubic phase having a stacking fault energy low enough to make it capable of being transformed under cavitation exposure to a fine deformation twinning, hexagonal close pack $\epsilon$-phase and/or $\alpha$-martensitic phase.

12. A stainless steel alloy as claimed in claim 11, said alloy consisting essentially of:
about 12% by weight of Co;
about 19% by weight of Cr;
about 0.2% by weight of C;
about 3% by weight of Mn; and
about 0.05% by weight of N;
the balance being substantially Fe.

13. A stainless steel alloy as claimed in claim 11, said alloy consisting essentially of:
about 8% by weight of Co;
about 13% by weight of Cr;
about 0.1% by weight of C;
about 9% by weight of Mn;
about 0.05% by weight of N; and
about 3% by weight of Si;
the balance being substantially Fe.

14. A stainless steel alloy as claimed in claim 11, said alloy consisting essentially of:
about 12% by weight of Co;
about 13% by weight of Cr;
about 0.2% by weight of C;
about 9% by weight of Mn; and
about 0.05% by weight of N;
the balance being substantially Fe.

15. A stainless steel alloy as claimed in claim 11, said alloy consisting essentially of:
about 12% by weight of Co;
about 19% by weight of Cr;
about 0.2% by weight of C;
about 9% by weight of Mn; and
about 0.05% by weight of N;
the balance being substantially Fe.

16. A stainless steel alloy as claimed in claim 1, said alloy consisting essentially of:
about 12% by weight of Co;
about 19% by weight of Cr;
about 0.2% by weight of C;
about 1% by weight of Si;
about 1% by weight of Mn; and
about 0.2% by weight of N;
the balance being substantially Fe.

* * * * *